US010307920B1

(12) United States Patent
Sanchez

(10) Patent No.: US 10,307,920 B1
(45) Date of Patent: Jun. 4, 2019

(54) HAIR CLIPPER VARIABLE COMB ATTACHMENT

(71) Applicant: Felix Sanchez, New York, NY (US)

(72) Inventor: Felix Sanchez, New York, NY (US)

( * ) Notice: Subject to any disclaimer, the term of this patent is extended or adjusted under 35 U.S.C. 154(b) by 0 days.

(21) Appl. No.: 15/926,080

(22) Filed: Mar. 20, 2018

Related U.S. Application Data

(60) Provisional application No. 62/474,224, filed on Mar. 21, 2017.

(51) Int. Cl.
*B26B 19/20* (2006.01)
*B26B 19/06* (2006.01)

(52) U.S. Cl.
CPC ..... *B26B 19/20* (2013.01); *B26B 19/06* (2013.01)

(58) Field of Classification Search
CPC ..... B26B 19/06; B26B 19/20
USPC ..... 30/233.5
See application file for complete search history.

(56) References Cited

U.S. PATENT DOCUMENTS 2,309,175 A 1/1943 Doggett
2,731,720 A 1/1956 Henard
3,030,707 A 4/1962 Garvey
3,032,875 A 5/1962 Gwynne
3,041,726 A * 7/1962 Hitson ..... B26B 19/20 30/201
3,986,258 A 10/1976 Liedtke
4,622,745 A * 11/1986 Wahl ..... B26B 19/20 30/201
5,084,974 A * 2/1992 Sukow ..... B26B 19/20 30/201
5,964,037 A 10/1999 Clark
6,079,103 A * 6/2000 Melton ..... B26B 19/20 30/43.92
6,243,955 B1 6/2001 Forbers et al.
7,080,458 B2 7/2006 Andis
8,782,905 B2 7/2014 Gonzales
8,844,142 B2 * 9/2014 Kammer ..... B26B 19/3846 30/201
9,027,252 B2 5/2015 Moseman
9,943,972 B2 * 4/2018 Werner ..... B26B 19/20
10,016,903 B2 * 7/2018 McCambridge ..... B26B 19/06
2010/0083508 A1 * 4/2010 Cheng ..... B26B 19/06 30/201

(Continued)

FOREIGN PATENT DOCUMENTS

EP 1510305 3/2005
WO WO2005009169 2/2005

*Primary Examiner* — Hwei-Siu C Payer
(74) *Attorney, Agent, or Firm* — Goldstein Law Offices, P.C.

(57) ABSTRACT

A hair clipper variable comb attachment, for use with a hair clipper having a fixed upper blade and a movable lower blade, including a blade mount, a main part, a comb carrier, and a pair of adjustment pegs. The comb carrier has a front and a plurality of longitudinally extending tines that increase in height as they extend rearwardly. The blade mount secures to the fixed upper blade of the clipper. The comb carrier is slidably attached onto the main part so that as the adjustment pegs are rotated the comb carrier can move forwardly with respect to the blade to increase cutting height of the clipper and can move rearwardly to decrease cutting height. Adjustment of the comb carrier position and thus the cutting height can be made without removing the comb attachment from the hair clipper.

10 Claims, 10 Drawing Sheets

(56) References Cited

U.S. PATENT DOCUMENTS

| | | | | |
|---|---|---|---|---|
| 2011/0107604 | A1* | 5/2011 | Julemont | B26B 19/20 30/201 |
| 2012/0240415 | A1 | 9/2012 | Tringali et al. | |
| 2014/0283867 | A1 | 9/2014 | McDonnell | |
| 2019/0009418 | A1* | 1/2019 | Baltussen | B26B 19/3826 |

* cited by examiner

HAIR CLIPPER VARIABLE COMB ATTACHMENT

CROSS REFERENCES AND RELATED SUBJECT MATTER

This application is a non-provisional filing of provisional patent application Ser. No. 62/474,224, filed in the United States Patent Office on Mar. 21, 2017, from which priority is claimed and which is incorporated by reference herein in its entirety.

TECHNICAL FIELD

The present disclosure relates generally to hair clippers. More particularly, the present disclosure relates to a variable comb attachment that mounts to a hair clipper that allows hair to be trimmed at various lengths using a single comb attachment.

BACKGROUND

Electric hair clippers are used by barbers and hair stylists to cut and shape human hair. These hair clippers conventionally provide a pair of blades, comprised of a reciprocating upper blade and a fixed lower plate. Both blades provide a plurality of teeth along their common edges. The reciprocating or movable blade moves in relation to the fixed blade, such that the teeth move in a rapid scissor-like motion.

Recent trends in hair styling have produced the so-called "faded haircut" or "fade", which creates an area of hair with gradually tapering lengths, typically on the sides and back of the head. Creating gradually tapering lengths of hair requires a great deal of time and skill on the part of the barber or hair stylist.

Comb attachments of various lengths are available, which hold the hair clippers at a consistent distance from the scalp, thus ensuring a consistent length of hair after the cut. Changing the comb attachments repeatedly will assist the barber or hair stylist in achieving a faded haircut, but is time consuming.

Great care and a steady hand are required to avoid a "stair-stepped" look, where the transition between different hair lengths created by different comb attachments is abrupt and obvious, which reflects poorly on the stylist. For all of these reasons, barbers and hair stylists who are inexperienced or lack confidence may decline to attempt a faded haircut.

While these hair clipper blades may be suitable for general use, they would not be as suitable for the purposes of the present disclosure as disclosed hereafter. Hair clipper blades and comb attachments, as disclosed in the prior art, require the barber or hair stylist (the user) to invest substantial time and skill in producing a faded haircut, creating a disadvantage when compared to more traditional or conventional haircuts.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a hair clipper attachment that may be easily used to produce a faded haircut without changing blades or changing detachable combs. Accordingly, the present disclosure describes a comb device that employs a movable comb that can adjust cutting length to produce a faded haircut without switching blades or combs.

Accordingly, the present disclosure describes a hair clipper variable comb attachment, for use with a hair clipper having a fixed upper blade and a movable lower blade, including a blade mount, a main part, a comb carrier, and a pair of adjustment pegs. The comb carrier has a front and a plurality of longitudinally extending tines that increase in height as they extend rearwardly. The blade mount secures to the fixed upper blade of the clipper. The comb carrier is slidably attached onto the main part so that as the adjustment pegs are rotated the comb carrier can move forwardly with respect to the blade to increase cutting height of the clipper and can move rearwardly to decrease cutting height. Adjustment of the comb carrier position and thus the cutting height can be made without removing the comb attachment from the hair clipper.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
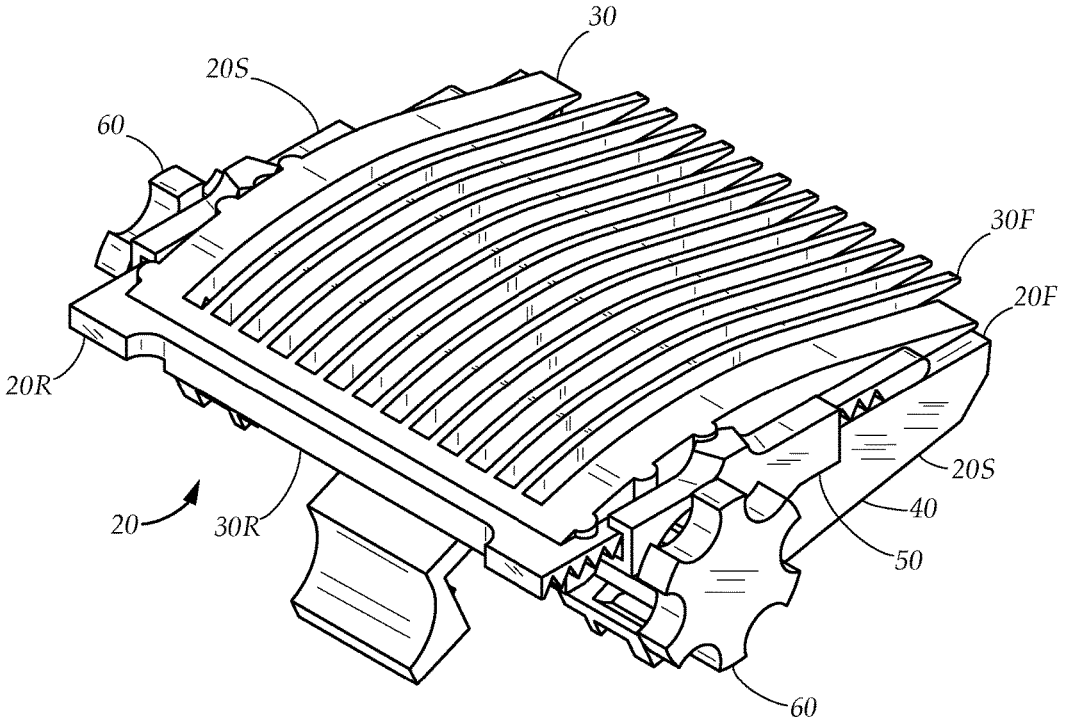
FIG. 1 is diagrammatic perspective view, illustrating the comb device, per se.
Figure 2:
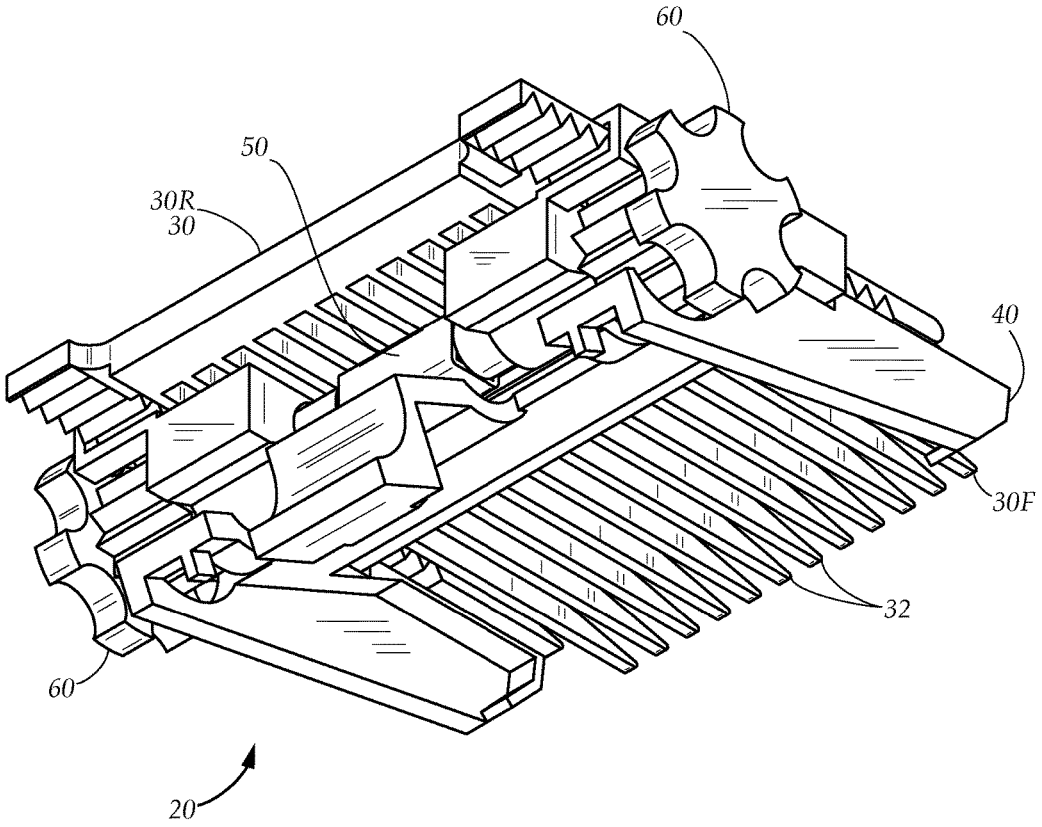
FIG. 2 is a diagrammatic perspective view, illustrating the comb device from an alternate viewing angle.

FIG. 1 and FIG. 2 illustrates a variable comb attachment device 20 having a front 20F, a rear 20R, and a pair of sides 20S. The comb device 20 includes a comb carrier 30, a blade mount 40, a main part 50, and a pair of adjustment pegs 60. The comb carrier 30 has a front 30F and a rear 30R and includes a plurality of longitudinally extending tines 32 that come to a point at the front, and are taller as they extend rearwardly on the comb carrier 30. The tines 32 are substantially evenly spaced apart. In accordance with principles of operation described in further detail hereinbelow, the comb carrier 30 is easily movable by the user by turning the adjustment pegs 60 to move the front 30F thereof forwardly to increase the length of hair about to be cut and rearwardly to decrease the length of hair about to be cut.

Figure 3:
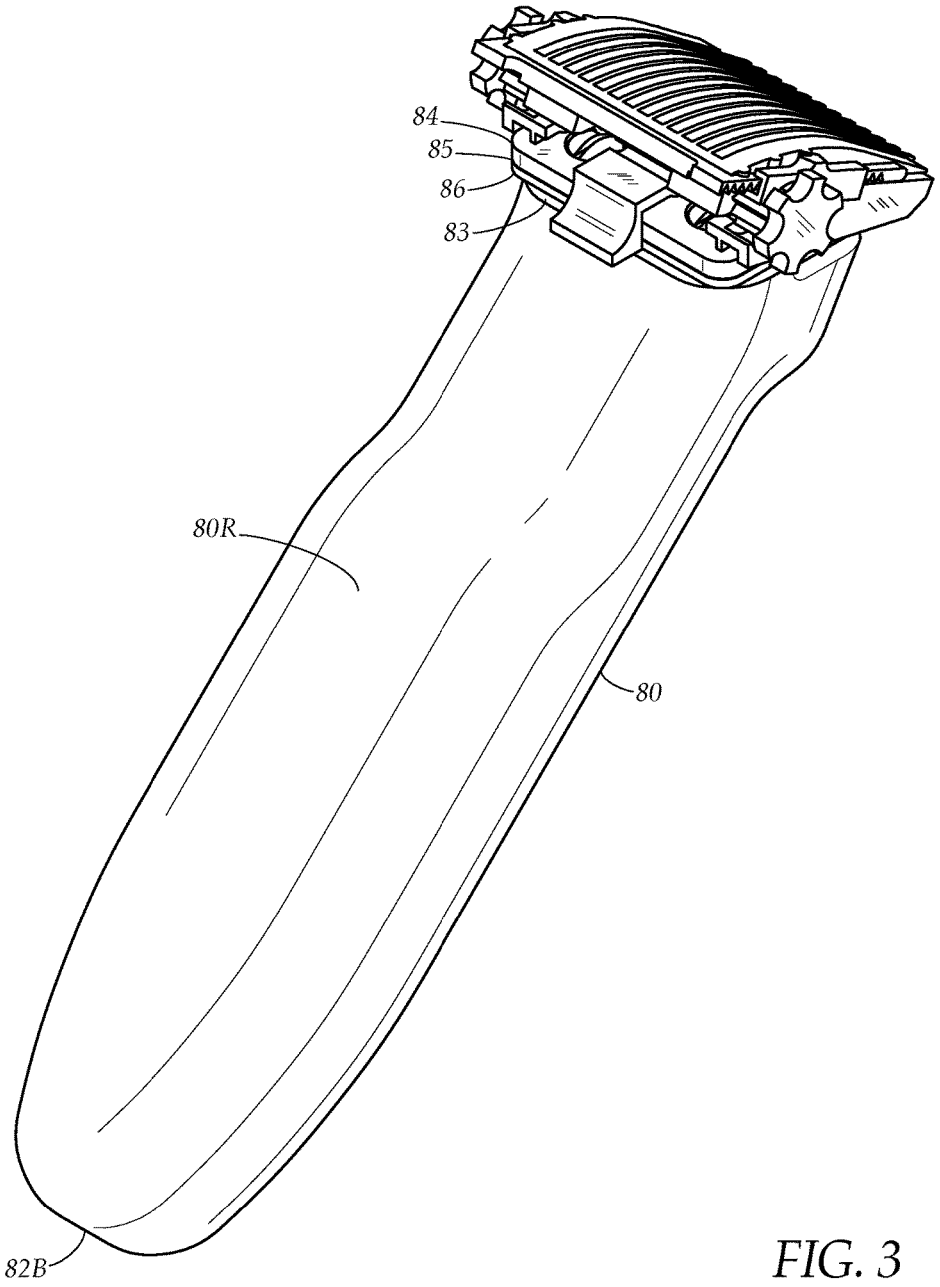
FIG. 3 is a diagrammatic perspective view, illustrating the comb device mounted onto a hair clipper.
Figure 4:
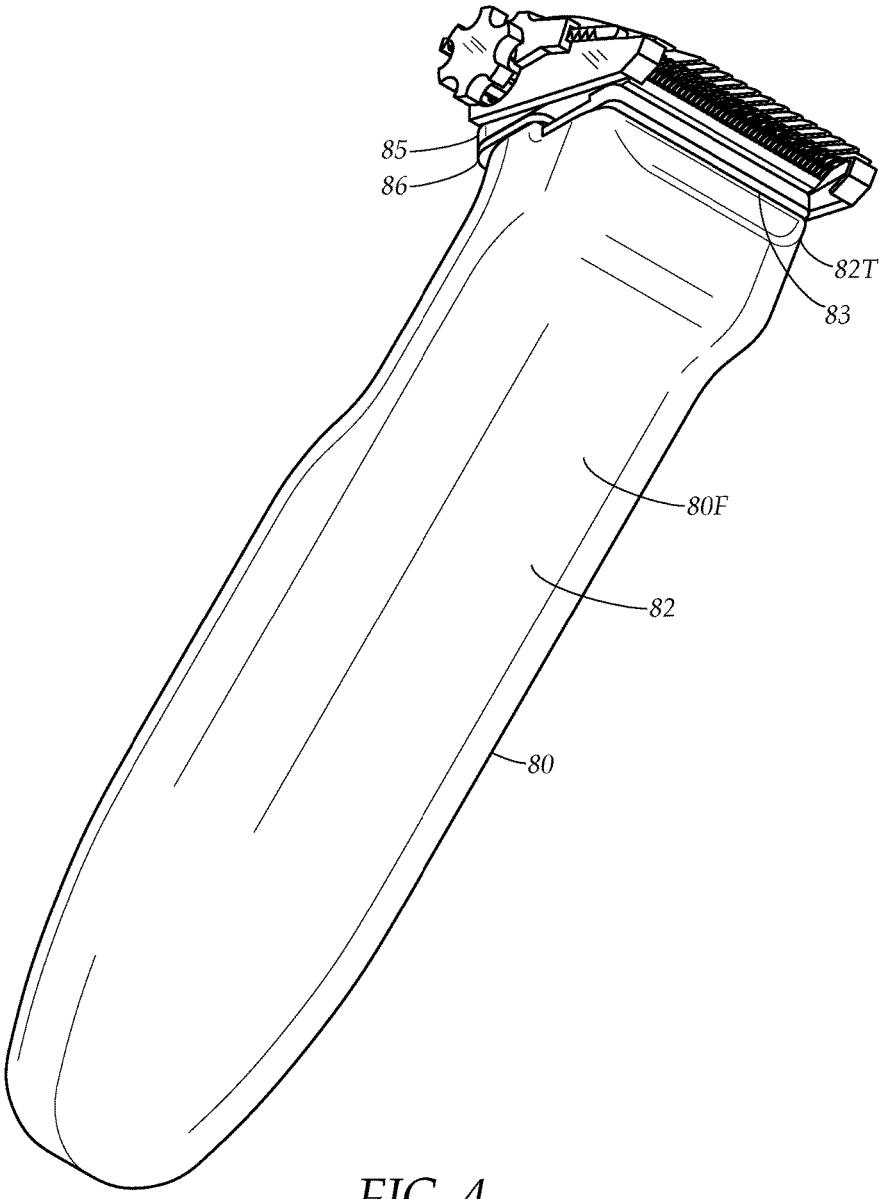
FIG. 4 is a diagrammatic perspective view, illustrating the comb device mounted onto a hair clipper from an alternate viewing angle.
Figure 6:
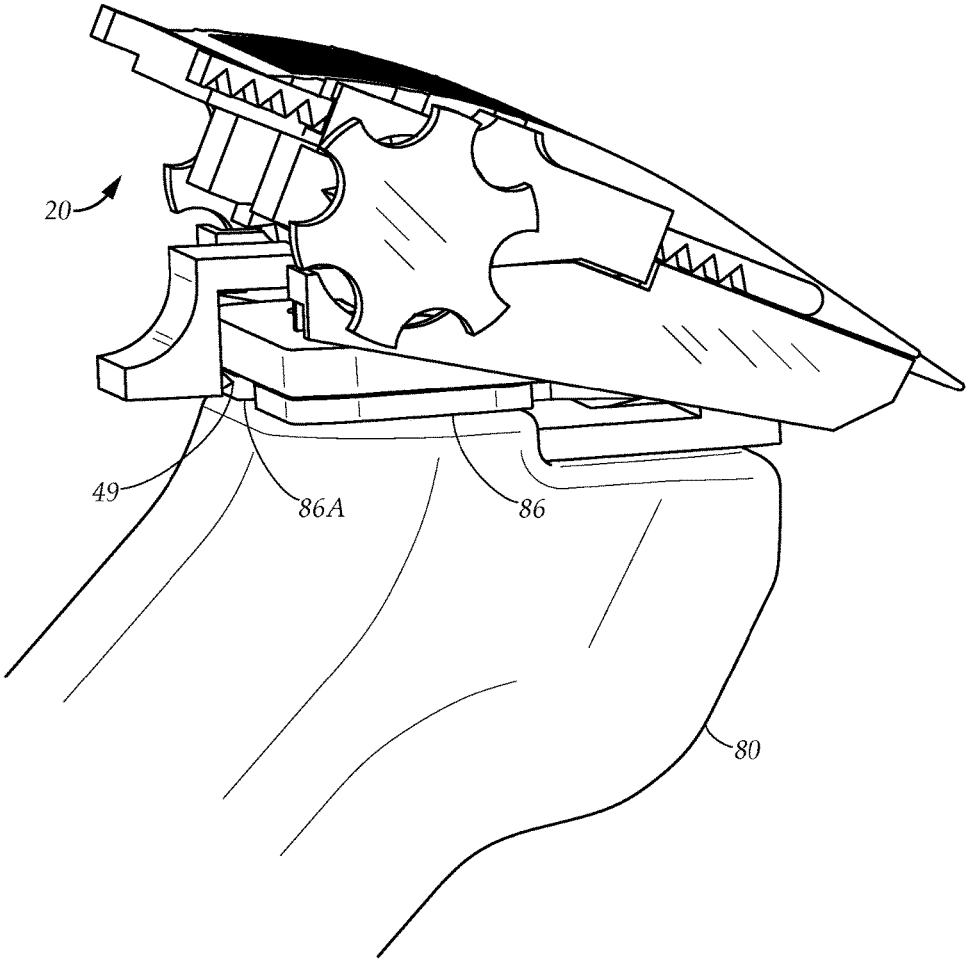
FIG. 6 is a diagrammatic perspective view, illustrating the fully assembled comb device secured onto the rear of the clipper blade.
Figure 7A:
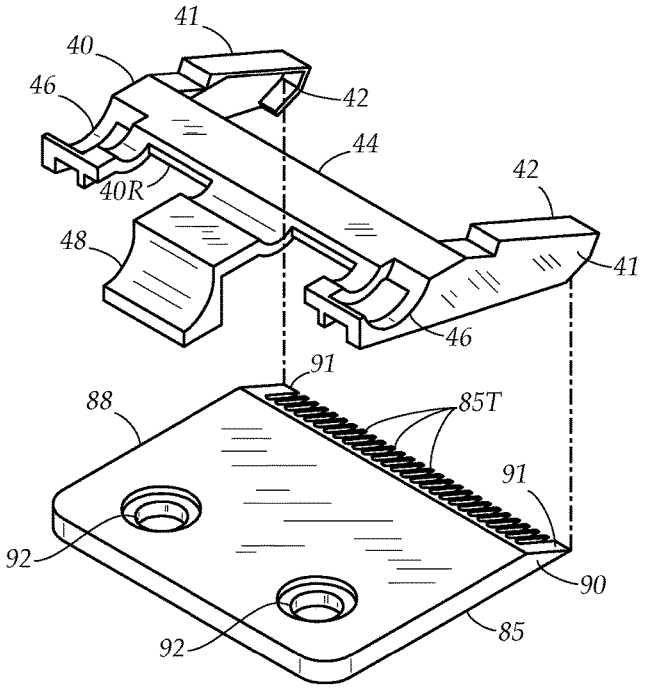
FIG. 7A illustrates the blade mount in conjunction with the clipper blade, showing the forward pockets into which the front side edges extend when mounting the comb device onto the clipper blade.
Figure 7B:
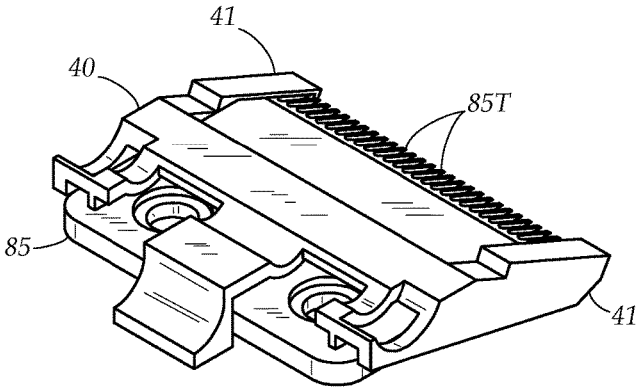
FIG. 7B illustrates the blade mount in conjunction with the clipper blade, showing the rear clip engaged with the rear of the clipper blade when the comb device is mounted onto the clipper blade.

Referring to FIG. 3 and FIG. 4, the comb device 20 is attached to a hair clipper 80. The hair clipper 80 includes a housing 82 that has a front 80F and rear 80R and also serves a handle during use, a bottom 82B, a top 82T, and a mounting plate 83 at the top 82T. The hair clipper 80 also includes a blade assembly 84 that includes a fixed upper blade 85 and a movable lower blade 86. The movable lower blade 86 is sandwiched between the fixed upper blade 85 and the mounting plate 83 and is reciprocated by the clipper to create a shearing cutting action. FIG. 7A further illustrates the fixed upper blade 85. In particular, the fixed upper blade 85 has a main plate 88 and a beveled forward portion 90 that contains a plurality of teeth 85T and a pair of forward side parts 91 that are beveled like the teeth but are significantly wider and are not configured for cutting. The main plate 88 has a pair of mounting holes 92 for securing the upper blade 85 to the mounting plate 83 (FIG. 3 and FIG. 4). Also seen in FIG. 7A, the blade mount 40 has a pair of side portions 41 that have a pair of opposed front pockets 42 that are shaped to fit over the forward side parts 91 of the upper blade 85. In addition, the blade mount 40 includes a bridge 44 that connects the side portions 41 and a pair of lower hemispherical wheel guides 46. The blade mount 40 has a rear 40R on an opposite end from the front pockets 42 and a blade clip 48 that extends rearwardly and downwardly from the bridge 44 at the rear 40R to secure beneath the fixed blade 85. In particular, referring to FIG. 6, a rear opening 86A is present at a rear edge of the lower movable blade 86. This rear opening 86A is conventionally employed for attaching combs onto the clipper 80. The blade clip 48 includes a tooth 49 that selectively extends into the rear opening 86A to lock the comb device 20 onto the clipper 80 at the rear of the blade. FIG. 7B shows the blade mount 40 fully seated onto the fixed upper blade 85 wherein the teeth 85T extend between the side portions 41.

Figure 5:
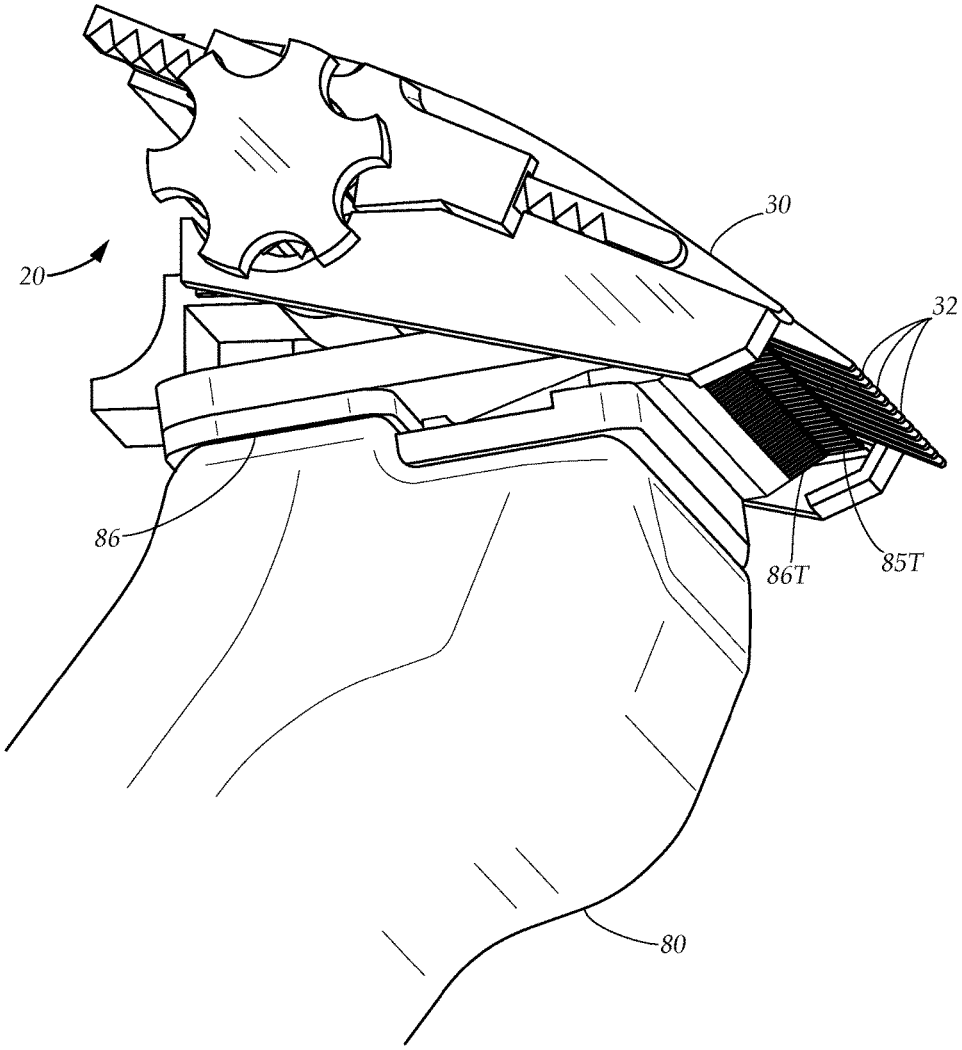
FIG. 5 is a diagrammatic perspective view, illustrating the fully assembled comb device secured onto the front of the clipper blade.

Referring to FIG. 5, the movable lower plate 86 also has teeth 86T. The movement of the lower plate 86 cause shearing between the teeth 85T of the upper plate 85 and the teeth 86T of the lower plate at a shearing plane therebetween. Note that as illustrated in FIG. 5, with the comb device 20 mounted onto the clipper 80, the comb carrier 30 can extend significantly forwardly of the teeth 85T. The effective height of the tines 32 where the cutting by the clipper 80 occurs increase as the comb carrier 30 is adjusted to move forwardly. The positioning of the comb carrier 30 can thereby effectively set a cutting length for the clipper 80, since hair must be at least as long as the tines 32 are tall at cutting plane of the intersection of the teeth 85T, 86T to be effectively cut thereby.

Figure 8:
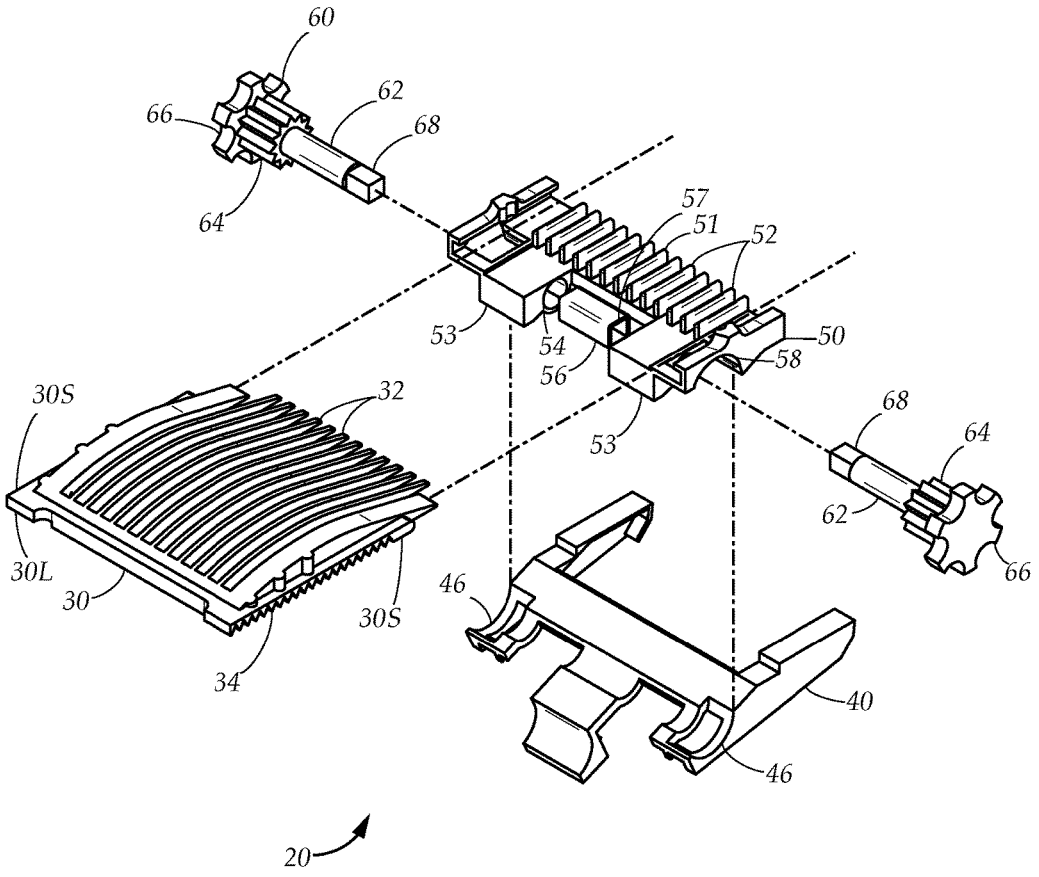
FIG. 8 is an exploded view, showing the interconnection of the main part, blade mount, comb carrier, and adjusting pegs.

FIG. 8 further detail the components of the comb device 20 that facilitate the movement of the comb carrier 30 to facilitate on-the-fly adjustment of hair cutting length. In particular, the main part 50 includes a track 51 with a plurality of protrusions 52 that spaced apart like the tines 32 and parallel to each other, for meshing with and guiding the tines 32 of the comb carrier 30 as the comb carrier is adjusted longitudinally. The main part 50 also includes a pair of peg mounting assemblies 53, that each include a peg channel 54, and also a square central tube 56 having side openings 57. The main part 50 also has a pair of upper hemispherical wheel guides 58 that match the lower hemispherical wheel guides 46 in the blade mount 40. As indicated, the main part 50 is attached on top of the blade mount 40 by any suitable means. When the main part 50 is attached to the blade mount 40, the upper and lower hemispherical wheel guides 46, 58 together form a shroud for a portion of the adjustment pegs 60. The comb carrier 30 has a pair of sides 30S and a lower surface 30L. A pair of racks 34 extend longitudinally on the lower surface 30L near the sides 30S. An adjustment mechanism allows relative adjustment of the comb carrier 30 and main part 50, and includes the adjustment pegs 60. The adjustment pegs 60 each have a main shaft 62 that is configured to extend within the peg channel 54, a pinion 64 that is configured to mesh with one of the racks 34, and a thumb wheel 66. Each adjustment peg 60 also has a square end 68 fully opposite from the thumb wheel 66 and attached axially to the main shaft 62 with a bearing such that the main shaft 62 can rotate with respect to the square end 68. The square end 68 extends into the square central tube 56 of the main part 50 where it is held in place and thereby stabilizes the adjustment pegs 60 while allowing free rotary motion of the thumb wheel 66 and pinion 64. In particular, as the thumb wheel 66 is rotated, its associated pinion 64 causes the rack 34 to move forwardly or rearwardly, thereby adjusting the relative position of the comb carrier 30 and main part 40.

Figure 9A:
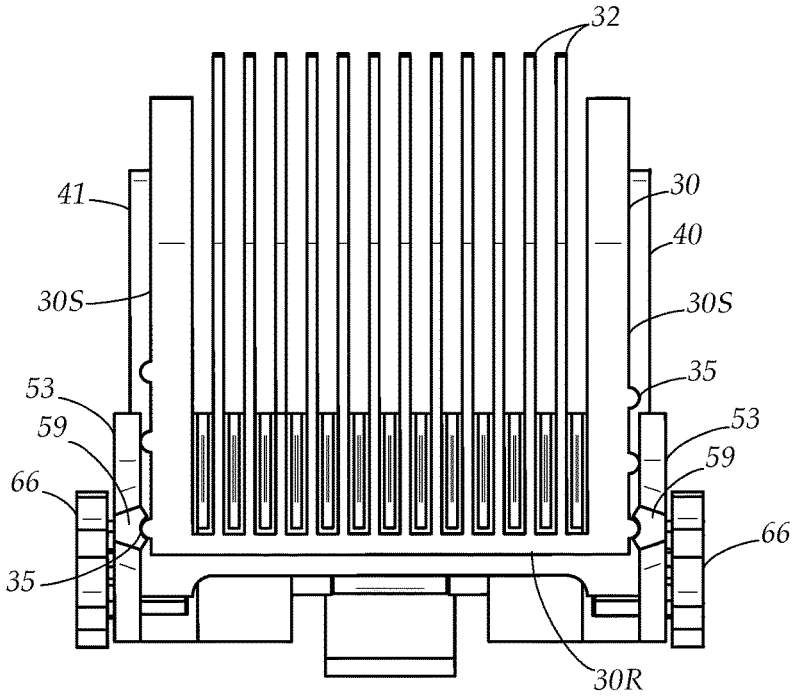
FIG. 9A is a top plan view, illustrating a notch mechanism for maintaining the comb carrier in an adjustment position, with the comb device in a first position.
Figure 9B:
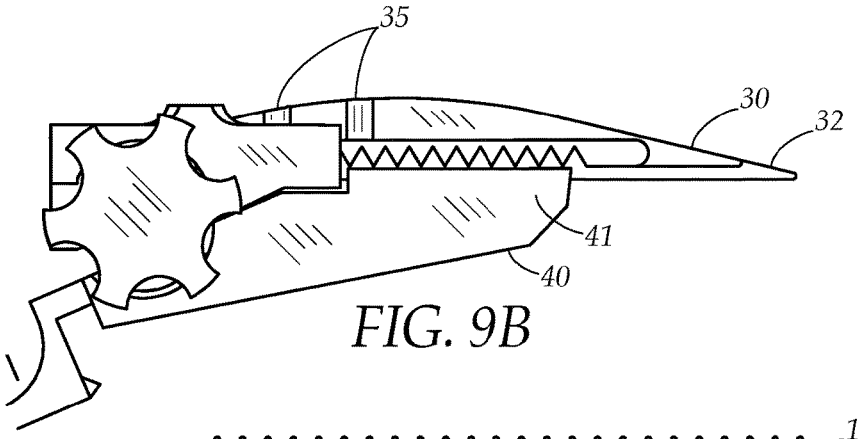
FIG. 9B is a side elevational view, illustrating the comb device in the first position.
Figure 9C:
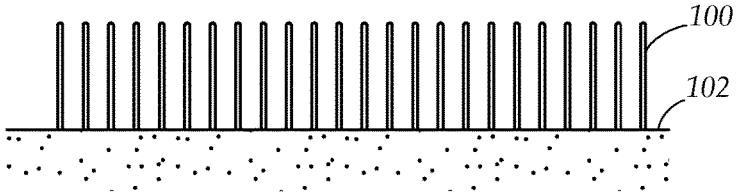
FIG. 9C is a side elevational view, illustrating hair in conjunction with a scalp, that is long in length, having been cut with the comb device set in the first position.
Figure 10A:
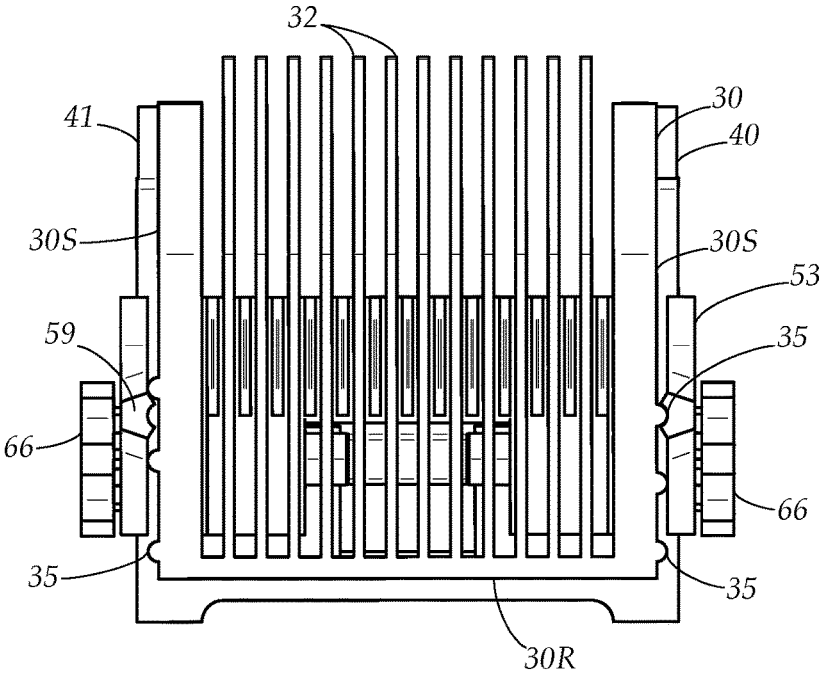
FIG. 10A is a top plan view, illustrating the comb device in a second position.
Figure 10B:
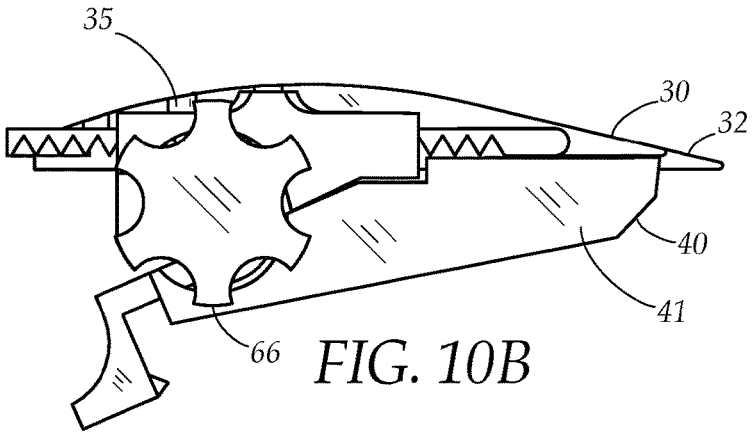
FIG. 10B is a side elevational view, illustrating the comb device in the second position.
Figure 10C:
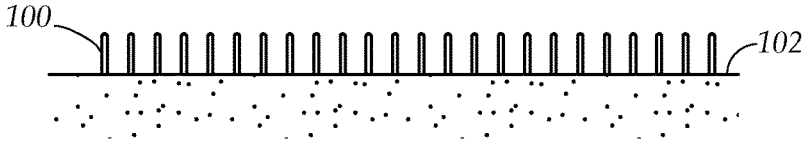
FIG. 10C is a side elevational view, illustrating hair in conjunction with a scalp, that is short in length, having been cut with the comb device set in the second position.

FIGS. 9A, 9B, and 10A, and 10B illustrated adjustment of the comb device 20 to modify the length of hair about to be cut using the clipper (not shown). FIG. 9C and FIG. 10C illustrates hair 100 growing from a scalp 102. The hair 100 has a length that is longer in FIG. 9C than in FIG. 10C. Note that the comb device 20 in FIGS. 9A and 9B is adjusted to a position of the comb carrier 30 where it can cut hair at the longer length shown in FIG. 9C. In FIGS. 10A and 10B, however, the comb device 20 is adjusted to a position where it would cut hair at the shorter length as shown in FIG. 10C. In particular, as illustrated in FIG. 9A and FIG. 9B, the comb carrier 30 is located further forwardly with respect to the blade mount 40 than in FIGS. 10A and 10B. Note the positioning of the tines 32 with respect to the side portions 41 of the blade mount. In FIG. 10A the tines 32 are only slightly forward of the side portions 41, and thus when mounted on the blade, the tines would provide very little height to reduce cutting by the teeth thereof.

FIG. 9A, FIG. 9B, FIG. 10A, and FIG. 10B also provide an example of mechanism for maintaining the comb carrier 30 in an adjusted position. In particular, the sides 30S of the comb carrier 30 have several protuberances 35, and the peg mounting assemblies 53 each have a notch 59 that is configured to interfere with the protuberances. In particular, once one of the protuberances 35 snaps into one of the notches 59, it will require some force on the thumb wheel 66 to deform the protuberance sufficiently so that it can move clear of the notch 59. Accordingly, interference between the notches 59 and protuberances 35 help the comb carrier 30 to effectively maintain an adjusted position until it is desirable to readjust it. Also note that the protuberances may be staggered in longitudinal position among the sides 30S of the comb carrier 30. In this way, only one of the notches 59 at a time may be required to hold the comb carrier 30 in position. Near the rear 30R of the comb carrier 30, however, two of the protuberances 35 may be aligned in substantially the same longitudinal position, as illustrated, which would require both of the thumb wheels 66 to move the comb carrier 30 beyond its final position and would thereby be effective in preventing the comb carrier 30 from coming off of its track.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a hair clipper variable comb attachment. The disclosure is illustrated by example in the drawing figures, and throughout the written description. It should be understood that numerous variations are possible, while adhering to the inventive concept. Such variations are contemplated as being a part of the present disclosure.

What is claimed is:

1. A variable comb device, for attachment to a hair clipper having a clipper blade assembly having a front, a rear, a fixed upper blade, and a movable lower blade, the fixed upper blade has a main plate and a beveled forward portion that contains a plurality of teeth and a pair of forward side parts that are beveled like the teeth but are wider and not configured for cutting, comprising:

a main part having a track with a plurality of protrusions that are spaced apart and parallel to each other, the main part also having a pair of peg mounting assemblies that each include a peg channel, and a square central tube having side openings;

a comb carrier having a front, a rear, a pair of sides, a lower surface, a pair of racks extending longitudinally on the lower surface near the sides, and a plurality of longitudinally extending tines that come to a point at the front and are taller as they extend rearwardly on the comb carrier, the tines mesh with the protrusions on the track which guide the movement of the tines as the comb carrier is adjusted longitudinally with respect to the main part;

a blade mount adapted for attaching to the clipper blade assembly, the main part mounted on top of the blade mount; and a pair of adjustment pegs, each having a main shaft, a pinion meshed with one of the racks, a thumb wheel, and a square end, the square end of each adjustment peg extends through one of the peg channels and into one of the side openings of the square central tube, the main shaft is adapted to rotate with respect to the square end so that when the thumb wheel is rotated the pinion rotates and causes the rack to move one of forwardly and rearwardly, adjusting the relative position of the comb carrier and the main part.

2. The variable comb device as recited in claim 1, wherein the blade mount has a pair of side portions that each have an opposed front pocket, a bridge that connects the side portions, and a blade clip, the opposed front pockets are adapted to fit over the forward side parts of the upper blade, and the blade clip includes a tooth that is adapted to selectively engage a rear of the blade to lock the comb device onto the upper clipper blade assembly.

3. The variable comb device as recited in claim 2, wherein the sides of the comb carrier each have several protuberances, and the peg mounting assemblies each have a notch that is configured to interfere with the protuberances, wherein once one of the protuberances snaps into one of the notches, it requires force on the thumb wheel to deform the protuberance so that it can move clear of the notch such that the protuberances help maintain the relative position of the comb carrier and the main part.

4. The variable comb device as recited in claim 3, wherein some of the protuberances of the sides of the comb carrier are staggered with respect to each other in a longitudinal position so that at any given time only one protuberance of said staggered protuberances can be engaged with one of the notches, except that near the rear of the comb carrier two of the protuberances are aligned in substantially the same longitudinal position to prevent the comb carrier from adjusting too far longitudinally with respect to the main part.

5. The variable comb device as recited in claim 4, wherein side portions of the blade mount each have a lower hemispherical wheel guide that is semicircular in shape; wherein the main part has a pair of upper hemispherical wheel guides that is semicircular in shape; and wherein the upper and lower hemispherical wheel guides together form a shroud for a portion of the adjustment pegs.

6. A variable comb device, for attachment to a hair clipper and modifying the length of hair about to be cut by said hair clipper, the hair clipper having a clipper blade assembly having a front, a rear, a fixed upper blade, and a movable lower blade, the fixed upper blade has a main plate and a beveled forward portion that contains a plurality of teeth and a pair of forward side parts that are beveled like the teeth but are wider and not configured for cutting, comprising:

a main part having a track with a plurality of protrusions that are spaced apart and parallel to each other;

a comb carrier having a front, a rear, a pair of sides, a lower surface, and a plurality of longitudinally extending tines that come to a point at the front and are taller as they extend rearwardly on the comb carrier, the tines mesh with the protrusions on the track which guide the movement of the tines as the comb carrier is adjusted longitudinally with respect to the main part;

a blade mount adapted for attaching to the clipper blade assembly, the main part mounted on top of the blade mount, the blade mount having a pair of side portions that each have an opposed front pocket, a bridge that connects the side portions, and a blade clip, the opposed front pockets are adapted to fit over the forward side parts of the upper blade, and the blade clip is adapted to selectively engage a rear of the upper blade to lock the comb device onto the clipper blade assembly; and an adjustment mechanism, for engaging the comb carrier and providing longitudinal movement of the tines with respect to the protrusions and thereby adapted to adjust the height of the tines at the front of the clipper blade assembly so that the comb carrier can be moved forwardly to increase the height of the tines at the front of the clipper to increase the length of hair about to be cut by the clipper blade assembly and rearwardly to decrease the height of the tines at the front of the clipper blade assembly to decrease the length of the hair about to be cut.

7. The variable comb device as recited in claim 6, wherein the comb carrier has a pair of racks extending longitudinally on the lower surface near the sides; wherein the main part has a pair of peg mounting assemblies that each include a peg channel, and a square central tube having side openings; and wherein the adjustment mechanism further comprises a pair of adjustment pegs, each having a main shaft, a pinion meshed with one of the racks, a thumb wheel, and a square end, the square end of each adjustment peg extends through one of the peg channels and into one of the side openings of the square central tube, the main shaft is adapted to rotate with respect to the square end so that when the thumb wheel is rotated the pinion rotates and causes the rack to move one of forwardly and rearwardly, adjusting the relative position of the comb carrier and the main part.

8. The variable comb device as recited in claim 7, wherein side portions of the blade mount each have a lower hemispherical wheel guide that is semicircular in shape; wherein the main part has a pair of upper hemispherical wheel guides that is semicircular in shape; and wherein the upper and lower hemispherical wheel guides together form a shroud for a portion of the adjustment pegs.

9. The variable comb device as recited in claim 8, wherein the sides of the comb carrier each have several protuberances, and the peg mounting assemblies each have a notch that is configured to interfere with the protuberances, wherein once one of the protuberances snaps into one of the notches, it requires force on the thumb wheel to deform the protuberance so that it can move clear of the notch such that the protuberances help maintain the relative position of the comb carrier and the main part.

10. The variable comb device as recited in claim 9, wherein some of the protuberances of the sides of the comb carrier are staggered with respect to each other in a longitudinal position so that at any given time only one protuberance of said staggered protuberances can be engaged with one of the notches, except that near the rear of the comb carrier two of the protuberances are aligned in substantially the same longitudinal position to prevent the comb carrier from adjusting too far longitudinally with respect to the main part.

* * * * *